US009612556B2

(12) United States Patent
Ogino et al.

(10) Patent No.: US 9,612,556 B2
(45) Date of Patent: Apr. 4, 2017

(54) FIXING DEVICE AND IMAGE FORMING APPARATUS

(71) Applicants: Yasuhiko Ogino, Kanagawa (JP); Kenji Ishii, Kanagawa (JP); Takashi Seto, Kanagawa (JP); Ippei Fujimoto, Kanagawa (JP); Kazuhito Kishi, Kanagawa (JP); Kazunari Sawada, Tokyo (JP); Hiroshi Yoshinaga, Chiba (JP); Hiromasa Takagi, Tokyo (JP); Takamasa Hase, Tokyo (JP); Hiroshi Seo, Kanagawa (JP); Susumu Matsusaka, Kanagawa (JP); Shohta Kobashigawa, Tokyo (JP)

(72) Inventors: Yasuhiko Ogino, Kanagawa (JP); Kenji Ishii, Kanagawa (JP); Takashi Seto, Kanagawa (JP); Ippei Fujimoto, Kanagawa (JP); Kazuhito Kishi, Kanagawa (JP); Kazunari Sawada, Tokyo (JP); Hiroshi Yoshinaga, Chiba (JP); Hiromasa Takagi, Tokyo (JP); Takamasa Hase, Tokyo (JP); Hiroshi Seo, Kanagawa (JP); Susumu Matsusaka, Kanagawa (JP); Shohta Kobashigawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/052,450

(22) Filed: Feb. 24, 2016

(65) Prior Publication Data

US 2016/0274511 A1 Sep. 22, 2016

(30) Foreign Application Priority Data

Mar. 17, 2015 (JP) ..... 2015-053151

(51) Int. Cl.
*G03G 15/20* (2006.01)

(52) U.S. Cl.
CPC ..... *G03G 15/2053* (2013.01); *G03G 15/2064* (2013.01); *G03G 2215/2035* (2013.01)

(58) Field of Classification Search
CPC ..... G03G 15/2053; G03G 15/2064; G03G 2215/2016; G03G 2215/2022; G03G 2215/2025; G03G 2215/2035
(Continued)

(56) References Cited

U.S. PATENT DOCUMENTS

2002/0127035 A1* 9/2002 Otsuka ..... G03G 15/2053 399/329
2005/0036809 A1* 2/2005 Fukita ..... G03G 15/206 399/328
(Continued)

FOREIGN PATENT DOCUMENTS

JP 6-095540 4/1994
JP 8-272240 10/1996
(Continued)

OTHER PUBLICATIONS

U.S. Appl. No. 14/836,129, filed Aug. 26, 2015.

*Primary Examiner* — Sophia S Chen
(74) *Attorney, Agent, or Firm* — Oblon, McClelland, Maier & Neustadt, L.L.P.

(57) ABSTRACT

A fixing device includes a heater to generate heat and a fixing rotator to rotate while contacting the heater. A pressure rotator presses against the heater via the fixing rotator to form a fixing nip between the fixing rotator and the pressure rotator, through which a recording medium bearing a toner image is conveyed. The heater includes an insulative substrate and a resistive heat generation layer mounted on the substrate. The resistive heat generation layer is disposed
(Continued)

upstream from a center of the fixing nip in a recording medium conveyance direction.

19 Claims, 7 Drawing Sheets

(58) Field of Classification Search
USPC ..... 399/329, 328, 330, 333; 219/216
See application file for complete search history.

(56) References Cited

U.S. PATENT DOCUMENTS

| | | | | |
|---|---|---|---|---|
| 2006/0133868 | A1* | 6/2006 | Kobayashi | G03G 21/1685 399/328 |
| 2006/0165446 | A1* | 7/2006 | Kikuchi | G03G 15/2064 399/329 |
| 2010/0028062 | A1* | 2/2010 | Nakahara | G03G 15/2064 399/329 |
| 2011/0058866 | A1 | 3/2011 | Ishii et al. | |
| 2011/0194869 | A1 | 8/2011 | Yoshinaga et al. | |
| 2012/0114345 | A1 | 5/2012 | Fujimoto et al. | |
| 2012/0121303 | A1 | 5/2012 | Takagi et al. | |
| 2012/0121304 | A1 | 5/2012 | Tokuda et al. | |
| 2013/0170880 | A1 | 7/2013 | Gotoh et al. | |
| 2014/0314459 | A1 | 10/2014 | Samei | |
| 2015/0055993 | A1 | 2/2015 | Shoji | |
| 2015/0055994 | A1 | 2/2015 | Shoji et al. | |
| 2015/0110531 | A1 | 4/2015 | Takagi et al. | |
| 2015/0125193 | A1 | 5/2015 | Ishii et al. | |
| 2015/0261155 | A1 | 9/2015 | Yoshiura et al. | |
| 2015/0261157 | A1 | 9/2015 | Yamano et al. | |
| 2015/0268626 | A1 | 9/2015 | Saito et al. | |
| 2016/0062281 | A1* | 3/2016 | Minamishima | G03G 15/2053 399/329 |

FOREIGN PATENT DOCUMENTS

| | | |
|---|---|---|
| JP | 2007-093899 | 4/2007 |
| JP | 2014-211571 | 11/2014 |
| JP | 2014-224924 | 12/2014 |
| JP | 2014-224927 | 12/2014 |
| JP | 2014-224999 | 12/2014 |
| JP | 2014-228706 | 12/2014 |
| JP | 2015-014704 | 1/2015 |
| JP | 2015-031841 | 2/2015 |
| JP | 2015-165277 | 9/2015 |

* cited by examiner

FIXING DEVICE AND IMAGE FORMING APPARATUS

CROSS-REFERENCE TO RELATED APPLICATION

This patent application is based on and claims priority pursuant to 35 U.S.C. §119 to Japanese Patent Application No. 2015-053151, filed on Mar. 17, 2015, in the Japanese Patent Office, the entire disclosure of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and a pressure rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the pressure rotator apply heat and pressure to the recording medium, melting and fixing the toner image on the recording medium.

SUMMARY

This specification describes below an improved fixing device. In one exemplary embodiment, the fixing device includes a heater to generate heat and a fixing rotator to rotate while contacting the heater. A pressure rotator presses against the heater via the fixing rotator to form a fixing nip between the fixing rotator and the pressure rotator, through which a recording medium bearing a toner image is conveyed. The heater includes an insulative substrate and a resistive heat generation layer mounted on the substrate. The resistive heat generation layer is disposed upstream from a center of the fixing nip in a recording medium conveyance direction.

This specification further describes an improved image forming apparatus. In one exemplary embodiment, the image forming apparatus includes an image bearer to bear a toner image and a fixing device disposed downstream from the image bearer in a recording medium conveyance direction to fix the toner image on a recording medium. The fixing device includes a heater to generate heat and a fixing rotator to rotate while contacting the heater. A pressure rotator presses against the heater via the fixing rotator to form a fixing nip between the fixing rotator and the pressure rotator, through which the recording medium bearing the toner image is conveyed. The heater includes an insulative substrate and a resistive heat generation layer mounted on the substrate. The resistive heat generation layer is disposed upstream from a center of the fixing nip in a recording medium conveyance direction.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
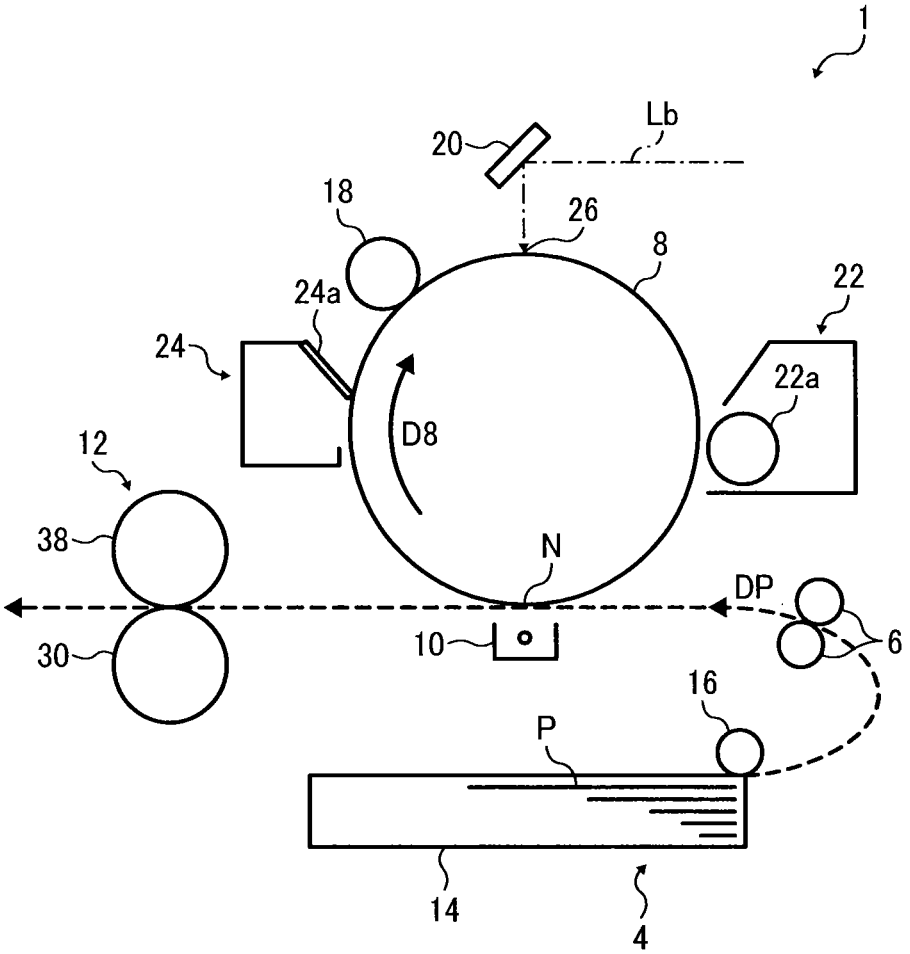
FIG. 1 is a schematic vertical cross-sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical cross-sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a monochrome printer that forms a monochrome toner image on a recording medium by electrophotography. Alternatively, the image forming apparatus 1 may be a color printer that forms a color toner image on a recording medium.

Referring to FIG. 1, a description is provided of a construction of the image forming apparatus 1.

As illustrated in FIG. 1, the image forming apparatus 1 includes a photoconductor 8 serving as an image bearer, a charging roller 18 serving as a charger, a mirror 20 constituting a part of an exposure device, a developing device 22 incorporating a developing roller 22*a*, a transfer device 10, and a cleaner 24 incorporating a cleaning blade 24*a*.

A light beam Lb reflected by the mirror 20 irradiates and scans the photoconductor 8 at an exposure position 26 thereon interposed between the charging roller 18 and the developing device 22 in a rotation direction D8 of the photoconductor 8. In a lower portion of the image forming apparatus 1 is a sheet feeder 4. A registration roller pair 6 is disposed in a conveyance path through which a sheet P picked up from the sheet feeder 4 is conveyed to an image forming device constructed of the photoconductor 8, the charging roller 18, the developing device 22, and the cleaner 24. The conveyance path is further provided with a fixing device 12 incorporating a fixing belt 38 and a pressure roller 30 at an end of the conveyance path in a sheet conveyance direction DP.

The sheet feeder 4 includes a paper tray 14 that loads a plurality of sheets P serving as recording media and a feed roller 16 that picks up and separates an uppermost sheet P from the plurality of sheets P loaded on the paper tray 14 and feeds the uppermost sheet P to the registration roller pair 6. The registration roller pair 6 temporarily halts the sheet P conveyed by the feed roller 16. Thereafter, the registration roller pair 6 corrects skew of the sheet P and conveys the sheet P to a transfer nip N formed between the photoconductor 8 and the transfer device 10 at a time in synchronism with rotation of the photoconductor 8, that is, at a time when a leading edge of a toner image formed on the photoconductor 8 corresponds to a predetermined position in a leading end of the sheet P in the sheet conveyance direction DP.

A description is provided of an image forming operation to form a toner image on a sheet P that is performed by the image forming apparatus 1 having the construction described above.

As the photoconductor 8 starts rotating in the rotation direction D8, the charging roller 18 uniformly charges an outer circumferential surface of the photoconductor 8. The exposure device emits a light beam Lb that scans the charged outer circumferential surface of the photoconductor 8 at the exposure position 26 thereon according to image data sent from an external device such as a client computer, thus forming an electrostatic latent image to be formed into a toner image on the photoconductor 8. The electrostatic latent image formed on the photoconductor 8 moves in accordance with rotation of the photoconductor 8 to an opposed position thereon disposed opposite the developing device 22 where the developing device 22 supplies toner to the electrostatic latent image on the photoconductor 8, visualizing the electrostatic latent image as a toner image.

As the toner image formed on the photoconductor 8 reaches the transfer nip N, the toner image is transferred onto a sheet P conveyed from the paper tray 14 and entering the transfer nip N at a predetermined time by a transfer bias applied by the transfer device 10. The sheet P bearing the unfixed toner image is conveyed to the fixing device 12 where the fixing belt 38 and the pressure roller 30 fix the toner image on the sheet P under heat and pressure. Thereafter, the sheet P bearing the fixed toner image is ejected onto an output tray disposed outside the image forming apparatus 1. Thus, the output tray stacks the sheet P.

As residual toner failed to be transferred onto the sheet P at the transfer nip N and therefore remaining on the photoconductor 8 moves under the cleaner 24 in accordance with rotation of the photoconductor 8, the cleaning blade 24*a* scrapes the residual toner off the photoconductor 8, thus cleaning the photoconductor 8. Thereafter, a discharger removes residual potential on the photoconductor 8, rendering the photoconductor 8 to be ready for a next image forming operation.

Figure 2:
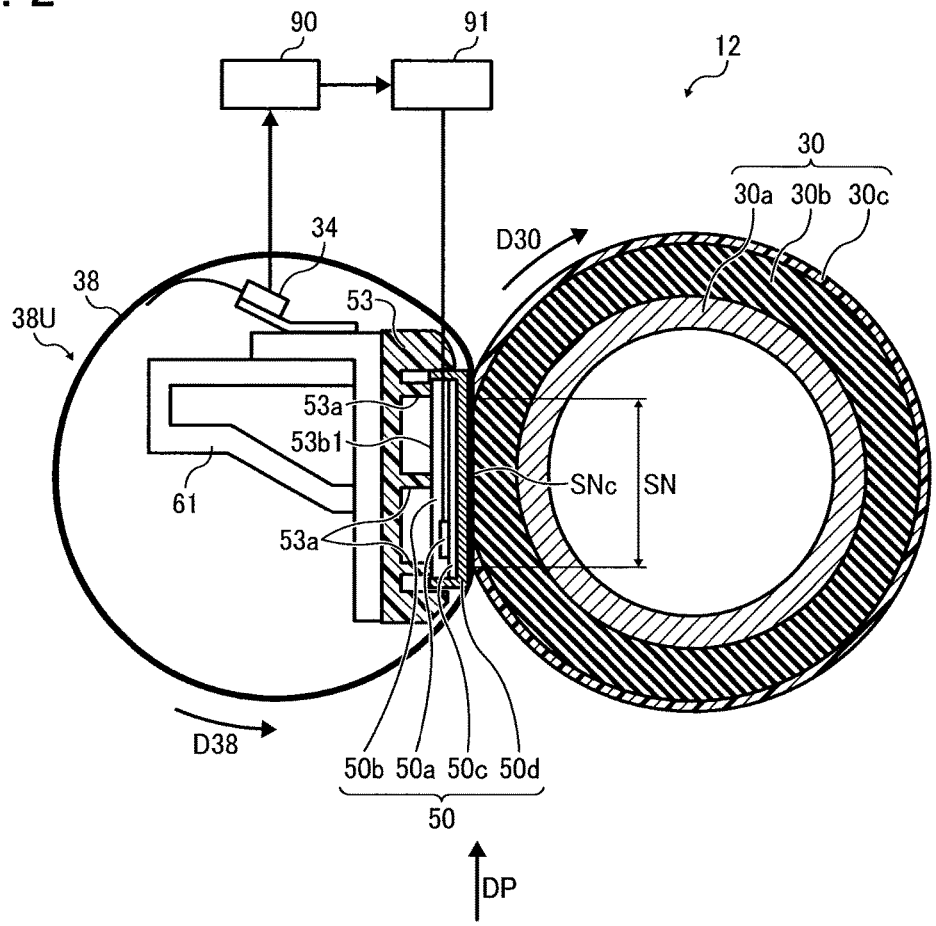
FIG. 2 is a schematic vertical cross-sectional view of a fixing device according to a first exemplary embodiment of the present disclosure that is incorporated in the image forming apparatus illustrated in FIG. 1.

Referring to FIG. 2, a description is provided of a construction of the fixing device 12 according to a first exemplary embodiment incorporated in the image forming apparatus 1 depicted in FIG. 1.

FIG. 2 is a schematic vertical cross-sectional view of the fixing device 12. As illustrated in FIG. 2, the fixing device 12 (e.g., a fuser or a fusing unit) includes a heater 50 configured to generate heat to heat the fixing belt 38; the fixing belt 38 serving as a fixing rotator or a fixing member configured to rotate in a rotation direction D38 while the fixing belt 38 contacts the heater 50; and the pressure roller 30 serving as a pressure rotator or a pressure member configured to rotate in a rotation direction D30 and press against the heater 50 via the fixing belt 38 to form a fixing nip SN between the fixing belt 38 and the pressure roller 30. The fixing device 12 further includes a temperature sensor 34 serving as a temperature detector that detects the temperature of the fixing belt 38 and a heating controller 90 configured to control energization of the heater 50 through a power supply 91 based on the temperature of the fixing belt 38 detected by the temperature sensor 34. The heating controller 90 may be disposed inside the fixing device 12 or the image forming apparatus 1 depicted in FIG. 1.

A detailed description is now given of a construction of the fixing belt 38.

The fixing belt 38 is a thin, flexible endless belt. The fixing belt 38 is constructed of a thin base layer, an elastic layer coating the base layer, and a release layer coating the elastic layer. The base layer, made of nickel (Ni), has an outer diameter of 30 mm and a thickness in a range of from 10 micrometers to 70 micrometers, for example. The elastic layer is made of a heat resistant elastic body such as silicone rubber and fluoro rubber and has a thickness in a range of from 50 micrometers to 150 micrometers, for example. The release layer serving as an outermost layer has a thickness in a range of from 5 micrometers to 50 micrometers and is made of fluorine resin such as tetrafluoroethylene-perfluoroalkylvinylether copolymer (PFA) and polytetrafluoroethylene (PTFE), for example, to enhance durability of the fixing belt 38 and facilitate separation of toner of the toner image on the sheet P from the fixing belt 38. Alternatively, the base layer of the fixing belt 38 may be made of metal such as SUS stainless steel or heat resistant resin such as polyimide (PI) instead of nickel.

A detailed description is now given of a construction of the pressure roller 30.

The pressure roller 30, that is, a roller rotatable in the rotation direction D30, is constructed of a hollow cored bar 30*a* made of iron, an elastic layer 30*b* coating the cored bar 30*a*, and a release layer 30*c* coating the elastic layer 30*b*. The pressure roller 30 has an outer diameter of 30 mm, for example. The elastic layer 30*b*, made of silicone rubber, has a thickness of 5 mm, for example. The release layer 30*c* is a fluorine layer having a thickness of about 40 micrometers and coating the elastic layer 30*b* to facilitate separation of the sheet P from the pressure roller 30. A biasing member (e.g., a spring) presses the pressure roller 30 against the heater 50 via the fixing belt 38.

A detailed description is now given of a configuration of the temperature sensor 34.

The temperature sensor 34 (e.g., a thermistor) is disposed downstream from the fixing nip SN in the rotation direction D38 of the fixing belt 38 to detect the temperature of the fixing belt 38. The heating controller 90 controls power supply to the heater 50 through the power supply 91 based on the temperature of the fixing belt 38 detected by the temperature sensor 34 so as to adjust the temperature of the fixing belt 38 to a desired temperature. The heating controller 90 (e.g., a processor) is a computer including a central processing unit (CPU), a read-only memory (ROM), a random-access memory (RAM), and an input-output (I/O) interface.

A detailed description is now given of a construction of the heater 50.

The heater 50 includes an insulative substrate 50*b* such as ceramics and a glass plate, a resistive heat generation layer 50*a* mounted on the substrate 50*b* by screen printing or the like, and an overcoat (OC) layer coating the resistive heat generation layer 50*a*. The heater 50 may further include a thermal conductor 50*d* serving as a thermal conductor A and a thermal conductor 50*c* serving as a thermal conductor B. The thermal conductors 50*d* and 50*c* are separable from the substrate 50*b* as separate components, respectively.

The substrate 50*b* made of ceramics (e.g., alumina) has a thermal conductivity of about 32 W/m·K. The substrate 50*b* made of glass has a thermal conductivity in a range of from about 1.3 W/m·K to about 1.6 W/m·K. The thermal conductor 50*d* is made of a material having an increased thermal conductivity, for example, copper, aluminum, or the like. The thermal conductor 50*d* made of copper has a thermal conductivity of about 400 W/m·K. The thermal conductor 50*d* made of aluminum has a thermal conductivity of about 240 W/m·K. In order to conduct heat from the heater 50 to the fixing nip SN effectively, the substrate 50*b* is made of glass to produce a differential in thermal conductivity between the substrate 50*b* and the fixing nip SN.

As illustrated in FIG. 2, the resistive heat generation layer 50*a* is disposed opposite the fixing belt 38 via the thermal conductors 50*c* and 50*d*. The thermal conductor 50*d* is extended and coupled with the fixing belt 38 throughout the entire width of the fixing nip SN in a longitudinal direction of the fixing nip SN parallel to an axial direction of the fixing belt 38. Accordingly, the thermal conductor 50*d* enhances conduction of heat at the fixing nip SN in the longitudinal direction thereof and therefore decreases variation in temperature of the fixing belt 38 in the axial direction thereof.

Since the fixing belt 38 contacts and slides over the thermal conductor 50*d* constantly while the fixing belt 38 rotates, the thermal conductor 50*d* is rubbed by the fixing belt 38 at an identical position on the thermal conductor 50*d* and therefore is susceptible to abrasion. As described above, since the thermal conductor 50*d* is separable from the substrate 50*b* as a separate component, the thermal conductor 50*d* is replaceable with new one. The substrate 50*b* and the resistive heat generation layer 50*a* that are expensive are not replaced together with the thermal conductor 50*d*, reducing running costs.

Alternatively, in order to reduce a slide torque and abrasion of the fixing belt 38 that slides over the thermal conductor 50*d*, a contact face of the thermal conductor 50*d* that contacts the fixing belt 38 may mount a low-friction coating layer. For example, the low-friction coating layer is made of a material having a decreased friction coefficient such as diamond-like carbon (DLC) and PTFE. The low-friction coating layer has a decreased thickness in a range of from about 2 micrometers to about 50 micrometers to enhance efficiency in heat conduction of the thermal conductor 50*d*. Yet alternatively, a fibrous sheet impregnated with a lubricant such as silicone oil may be sandwiched between the fixing belt 38 and the thermal conductor 50*d* to decrease friction between the thermal conductor 50*d* and the fixing belt 38.

Since the substrate 50*b* and the thermal conductor 50*d* have an increased rigidity, the thermal conductor 50*d* may not be in contact with or disposed opposite the substrate 50*b* evenly throughout the entire width in a longitudinal direction of the heater 50 parallel to the axial direction of the fixing belt 38 due to at least one of the surface roughness, bending, or warping of the substrate 50*b* and the thermal conductor 50*d*. To address this circumstance, the elastic thermal conductor 50*c* elastically deformable along a surface of each of the substrate 50*b* and the thermal conductor 50*d* is interposed between the substrate 50*b* and the thermal conductor 50*d*. The thermal conductor 50*c* is conductive grease or a conductive sheet made of Thermal Interface Material (TIM) or the like. The thermal conductor 50*c* is one example of a thermal conductor supplement.

The thermal conductor 50*c* may be a graphite sheet having an anisotropic thermal conductivity. The graphite sheet achieves an increased thermal conductivity in a plane direction that is greater than a decreased thermal conductivity in a thickness direction. Accordingly, the thin graphite sheet heats a surface of the fixing nip SN, that is, a surface of the fixing belt 38 at the fixing nip SN, quickly. Even if the temperature of the fixing nip SN is uneven in the axial direction of the fixing belt 38 while the sheet P is conveyed through the fixing device 12, the graphite sheet evens the temperature of the fixing belt 38 quickly.

If the thermal conductor 50*c* is made of silicone grease added with metal particles such as zinc oxide, the thermal conductor 50*c* adheres to the thermal conductor 50*d* precisely while attaining a desired thermal conductivity.

A detailed description is now given of a construction of a heater holder 53 incorporated in the fixing device 12.

The heater holder 53 supports the heater 50. The heater holder 53 is susceptible to temperature increase or overheating as the heater holder 53 receives heat from the heater 50. To address this circumstance, the heater holder 53 is made of heat resistant resin such as liquid crystal polymer (LCP), polyphenylene sulfide (PPS), polyamide imide (PAI), polyimide (PI), and polyether ether ketone (PEEK). The heater holder 53 made of resin having a decreased thermal conductivity achieves an enhanced insulation.

As illustrated in FIG. 2, the heater holder 53 includes a plurality of projections 53*a* that contacts a back face 50*b*1 of the substrate 50*b* opposite a front face of the substrate 50*b* that mounts the resistive heat generation layer 50*a*, thus supporting the heater 50 and decreasing the area of the heater holder 53 where the heater holder 53 contacts the substrate 50*b*. Accordingly, the heater holder 53 decreases an amount of heat conducted from the heater 50 to the heater holder 53, facilitating conduction of heat to the thermal conductors 50*d* and 50*c* and the fixing belt 38.

A detailed description is now given of a configuration of a stay 61 incorporated in the fixing device 12.

The stay 61 supports the heater holder 53. The stay 61 is supported by a plurality of side plates disposed at both lateral ends of the fixing device 12 in a longitudinal direction thereof parallel to the axial direction of the fixing belt 38, respectively. The stay 61 supports the heater holder 53 and the heater 50 against pressure from the pressure roller 30.

The fixing belt 38 and the components disposed inside a loop formed by the fixing belt 38, that is, the heater 50, the heater holder 53, the temperature sensor 34, and the stay 61, may constitute a belt unit 38U separable coupled with the pressure roller 30.

A description is provided of configurations of comparative fixing devices.

The comparative fixing devices include a thin belt or film and a resistive heater constructed of a substrate made of ceramics or glass and a resistive heat generator mounted on the substrate.

A first comparative fixing device includes a thin, tubular heat resistant film, a platy heater contacting the film, and a pressure roller. The heater and the pressure roller sandwich a recording medium to adhere the recording medium to the film so as to conduct heat from the heater to a recording medium through the film. The thin film having a thickness of about 100 micrometers causes a warm-up time to warm up the film from an ambient temperature to a desired fixing temperature to be equivalent to a time taken to heat the platy heater having a decreased thermal capacity. Accordingly, the film shortens the warm-up time and reduces power consumed for preheating.

A second comparative fixing device includes a thin, tubular heat resistant film, a metal substrate, an insulative layer made of ceramics, glass, or the like and mounted on the substrate, and a resistive heat generator mounted on the insulative layer. The resistive heat generator heats the film through the metal substrate. With a configuration in which the platy heater heats the thin film directly, the film is susceptible overheating in a non-conveyance span of the film where a recording medium is not conveyed, resulting in abrasion and degradation in durability of the film. To address this circumstance, the metal substrate equalizes heat conducted from the resistive heat generator in a longitudinal direction of the metal substrate, preventing overheating of the non-conveyance span of the film.

However, the configuration described above in which the heater and the pressure roller sandwich the film and the recording medium to apply heat and pressure to the recording medium may have the following disadvantages. For example, when the heater heats the cool film, the recording medium may have passed through a fixing nip formed between the film and the pressure roller before the heater heats the recording medium sufficiently, wasting energy. Accordingly, the warm-up time taken to heat toner of a toner image formed on the recording medium to the desired fixing temperature may increase and therefore power consumption may increase.

A description is provided of an advantageous configuration of the fixing device 12.

The length of the fixing nip SN depicted in FIG. 2 in the sheet conveyance direction DP and the conveyance speed at which the sheet P is conveyed are adjusted properly according to a target quality of the toner image on the sheet P and a target productivity of the fixing device 12. For example, in a case in which the length of the fixing nip SN in the sheet conveyance direction DP is 10 mm and the conveyance speed of the sheet P is 250 mm/s, a nip time when the sheet P is conveyed through the fixing nip SN is 0.04 seconds. Under the decreased nip time, if the resistive heat generation layer 50*a* is disposed opposite a center SNc of the fixing nip SN in the sheet conveyance direction DP, the heater 50 does not heat the sheet P sufficiently before the sheet P reaches an exit of the fixing nip SN, resulting in degradation in heat conduction efficiency of the heater 50.

To address this circumstance, the resistive heat generation layer 50*a* according to this exemplary embodiment has a length in the sheet conveyance direction DP that is smaller than the length of the fixing nip SN in the sheet conveyance direction DP and is disposed upstream from the center SNc of the fixing nip SN in the sheet conveyance direction DP. Accordingly, the resistive heat generation layer 50*a* increases an amount of heat conducted from the heater 50 to toner of the toner image on the sheet P compared to a comparative configuration of the resistive heat generation layer 50*a* disposed opposite or disposed downstream from the center SNc of the fixing nip SN in the sheet conveyance direction DP.

Figure 3:
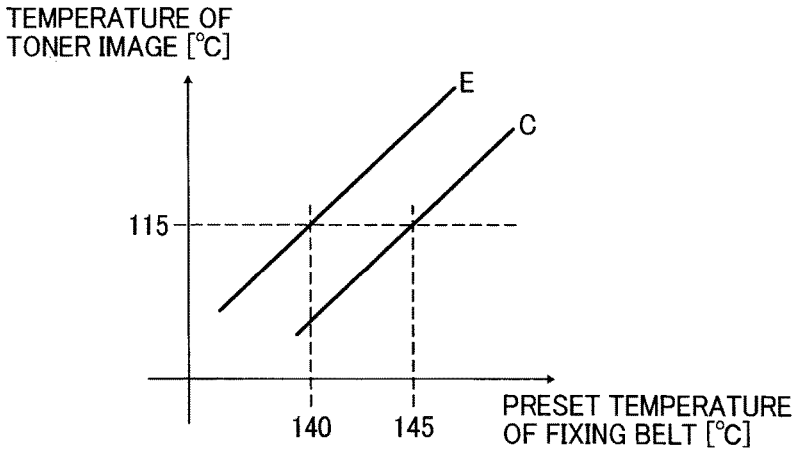
FIG. 3 is a graph illustrating a relation between a preset temperature of an outer circumferential surface of a fixing belt incorporated in the fixing device illustrated in FIG. 2 and a temperature of a surface of a toner image on a sheet at an exit of a fixing nip.

FIG. 3 is a graph illustrating a relation between a preset temperature of an outer circumferential surface of the fixing belt 38 and a temperature of a surface of the toner image on the sheet P at the exit of the fixing nip SN. A horizontal X-axis of the graph represents the preset temperature in Celsius of the outer circumferential surface of the fixing belt 38. A vertical Y-axis of the graph represents the temperature in Celsius of the surface of the toner image on the sheet P at the exit of the fixing nip SN. The graph plots a result C achieved with a comparative resistive heat generation layer and a result E achieved with the resistive heat generation layer 50*a* according to this exemplary embodiment.

The comparative resistive heat generation layer and the resistive heat generation layer 50*a* have an identical configuration except that the comparative resistive heat generation layer is disposed opposite the center SNc of the fixing nip SN in the sheet conveyance direction DP. As illustrated in FIG. 3, if the temperature of the surface of the toner image on the sheet P at which toner of the toner image is fixed on the sheet P sufficiently is 115 degrees centigrade, the preset temperature of the outer circumferential surface of the fixing belt 38 is 145 degrees centigrade with the comparative resistive heat generation layer. Conversely, the preset temperature of the outer circumferential surface of the fixing belt 38 is 140 degrees centigrade with the resistive heat generation layer 50*a* according to this exemplary embodiment. That is, the resistive heat generation layer 50*a* decreases the preset temperature of the outer circumferential surface of the fixing belt 38 by 5 degrees centigrade compared to the comparative resistive heat generation layer. Accordingly, the fixing device 12 incorporating the resistive heat generation layer 50*a* shortens the warm-up time and decreases power consumption.

Figure 4:
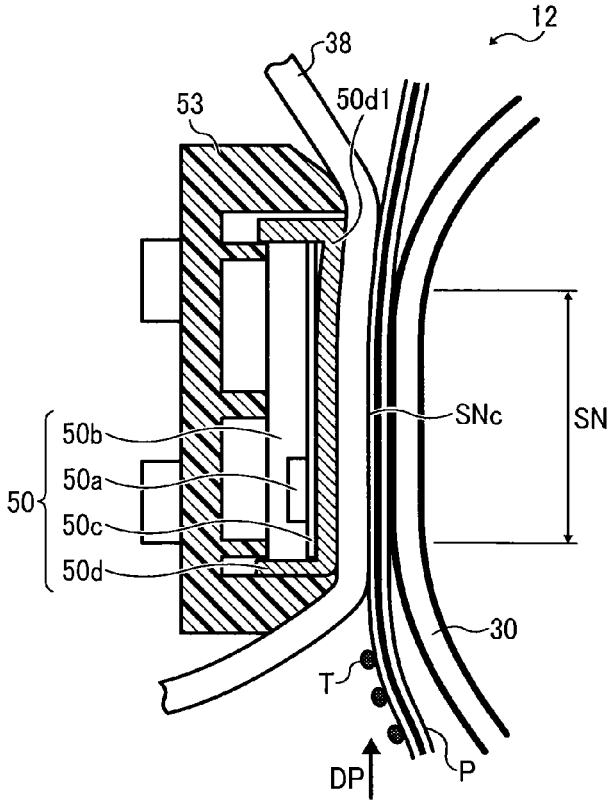
FIG. 4 is an enlarged vertical cross-sectional view of the fixing device illustrated in FIG. 2 illustrating the fixing nip.

FIG. 4 is an enlarged vertical cross-sectional view of the fixing device 12 according to the first exemplary embodiment illustrating the fixing nip SN. The thermal conductor 50*d* is U-shaped in cross-section and is inserted in a gap between the substrate 50*b* and the heater holder 53 in a short direction of the heater holder 53 parallel to the sheet conveyance direction DP. The substrate 50*b* is confined by the heater holder 53 and the thermal conductor 50*d*. Accordingly, even if the substrate 50*b* is broken, the heater holder 53 and the thermal conductor 50*d* prevent fragments of the substrate 50*b* from scattering. If conductive grease is used as the thermal conductor 50*c*, the viscosity of the conductive grease may decrease when the heater 50 heats the fixing belt 38 and therefore the conductive grease may outflow from the heater 50. To address this circumstance, the thermal conductor 50*d* caps the thermal conductor 50*c*, preventing overflow of the conductive grease. The thermal conductor 50*d* is manufactured at reduced costs with a thin copper plate by extrusion molding or the like.

As illustrated in FIG. 4, the thermal conductor 50*d* includes a projection 50*d*1 projecting from a downstream end of the thermal conductor 50*d* in the sheet conveyance direction DP toward the pressure roller 30. The projection 50*d*1 directs the sheet P toward the pressure roller 30, facilitating separation of the sheet P from the fixing belt 38. The projection 50*d*1 is disposed downstream from the fixing nip SN in the sheet conveyance direction DP. Accordingly, pressure exerted at the fixing nip SN disposed upstream from the projection 50*d*1 in the sheet conveyance direction DP is substantially equivalent to pressure exerted at the planar fixing nip SN defined by the thermal conductor 50*d* not incorporating the projection 50*d*1.

As described above, the resistive heat generation layer 50*a* is disposed upstream from the center SNc of the fixing nip SN in the sheet conveyance direction DP, increasing an amount of heat conducted to a toner image T on the sheet P, shortening the warm-up time, and reducing power consumption.

The thermal conductors 50*d* and 50*c* are separable from the substrate 50*b* and the resistive heat generation layer 50*a* for replacement. That is, the thermal conductors 50*d* and 50*c* are replaceable with new ones separately from the substrate 50*b* and the resistive heat generation layer 50*a* that are expensive, reducing running costs.

The thermal conductor 50*d* is a metal plate extended and coupled with the fixing belt 38 throughout the entire width of the fixing nip SN in the longitudinal direction of the fixing nip SN parallel to the axial direction of the fixing belt 38. Accordingly, the thermal conductor 50*d* equalizes heat stored in the fixing belt 38 at the fixing nip SN evenly in the longitudinal direction of the fixing nip SN, decreasing overheating of a non-conveyance span of the fixing belt 38 in the axial direction thereof where the sheet P is not conveyed over the fixing belt 38.

A description is provided of a configuration of a fixing device 12S according to a second exemplary embodiment.

Figure 5:
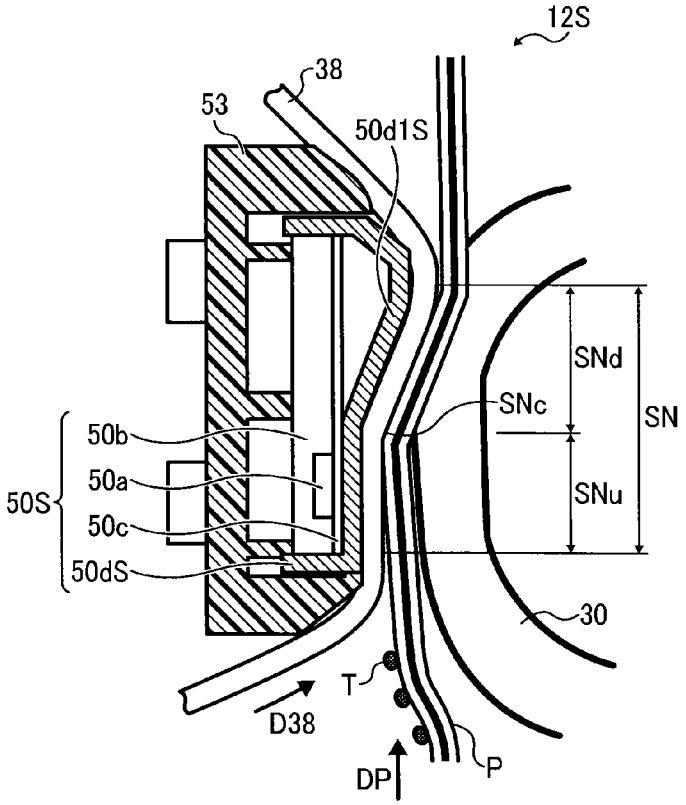
FIG. 5 is an enlarged vertical cross-sectional view of a fixing device according to a second exemplary embodiment of the present disclosure illustrating the fixing nip.

FIG. 5 is an enlarged vertical cross-sectional view of the fixing device 12S illustrating the fixing nip SN. It is to be noted that identical reference numerals are assigned to components illustrated in FIG. 5 that are identical to the components illustrated in FIG. 4 and description of the identical components is omitted.

The fixing device 12S according to the second exemplary embodiment is different from the fixing device 12 according to the first exemplary embodiment described above in the shape of a heater 50S. The heater 50S includes a thermal conductor 50*d*S including a projection 50*d*1S being disposed opposite a downstream portion SNd of the fixing nip SN in the sheet conveyance direction DP and projecting toward the pressure roller 30. For example, the projection 50*d*1S is tilted toward the pressure roller 30 in cross-section in a span defined from a downstream end of an upstream portion SNu of the fixing nip SN to a downstream end of the downstream portion SNd of the fixing nip SN in the sheet conveyance direction DP. Accordingly, pressure exerted at the exit of the fixing nip SN is greater than pressure exerted at an entry to the fixing nip SN.

Figure 6:
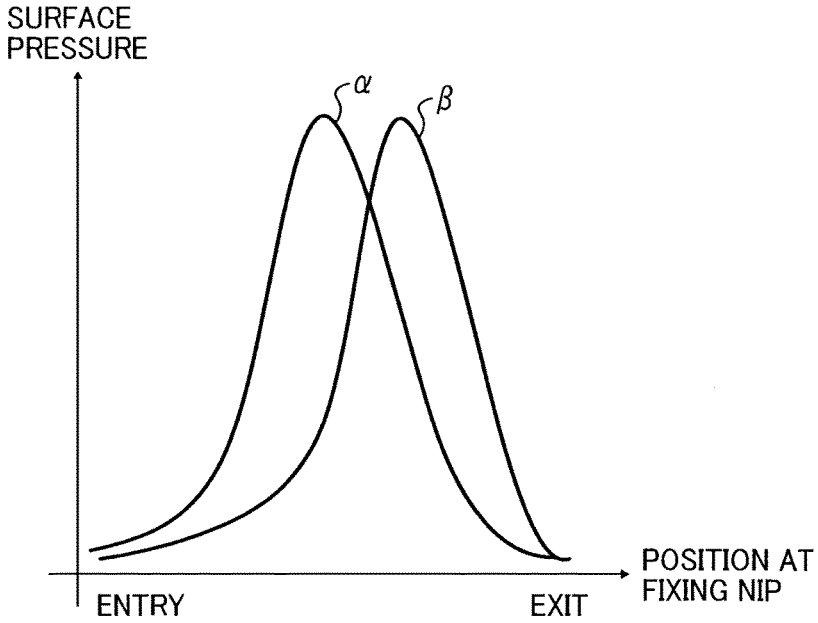
FIG. 6 is a graph illustrating a pressure distribution at the fixing nip of a comparative fixing device and the fixing device illustrated in FIG. 5.

FIG. 6 is a graph illustrating a pressure distribution at the fixing nip SN. A horizontal X-axis represents the position at the fixing nip SN in the sheet conveyance direction DP. A vertical Y-axis represents surface pressure exerted at the fixing nip SN. The graph plots data α and β. The data α represents a pressure distribution of a comparative, planar fixing nip. The data β represents a pressure distribution of the fixing nip SN defined by the thermal conductor 50*d*S of the fixing device 12S illustrated in FIG. 5.

The data α indicates that the surface pressure exerted at the fixing nip SN increases at the center SNc of the fixing nip SN in the sheet conveyance direction DP and decreases at the entry to the fixing nip SN and the exit of the fixing nip SN in accordance with the shape of an outer circumferential surface of the pressure roller 30. Conversely, the data β indicates that the surface pressure exerted at the exit of the fixing nip SN is greater than the surface pressure exerted at the entry to the fixing nip SN. That is, the pressure distribution is inclined to the downstream portion SNd of the fixing nip SN in the sheet conveyance direction DP.

Referring back to FIG. 5, a description is provided of the configuration of the fixing device 12S according to the second exemplary embodiment.

Although the thermal conductor 50*d*S is a metal plate having an increased thermal conductivity, the thermal conductor 50*d*S has a decreased thermal capacity to shorten the warm-up time and reduce power consumption. For example, as illustrated in FIG. 5, the thermal conductor 50*d*S is molded into a thin plate having a substantially uniform thickness.

The resistive heat generation layer 50*a* adheres to the thermal conductor 50*d*S in a longitudinal direction of the thermal conductor 50*d*S or substantially adheres to the thermal conductor 50*d*S via the thermal conductor 50*c* to heat the upstream portion SNu of the fixing nip SN in the sheet conveyance direction DP directly. The fixing belt 38 is heated at the fixing nip SN by heat generated by the resistive heat generation layer 50*a*. However, since the fixing belt 38 rotates in the rotation direction D38, the fixing belt 38 achieves an increased temperature at the downstream portion SNd of the fixing nip SN in the sheet conveyance direction DP.

The thermal conductor 50*d*S that increases pressure at the exit of the fixing nip SN rather than at the entry to the fixing nip SN allows the fixing belt 38 and the pressure roller 30 to exert increased pressure to the toner image T on the sheet P at an increased temperature facilitating melting of toner of the toner image T compared to a thermal conductor that increases pressure at the center SNc of the fixing nip SN in the sheet conveyance direction DP, thus enhancing fixing property of fixing the toner image T on the sheet P. For example, the resistive heat generation layer 50*a* disposed opposite the upstream portion SNu of the fixing nip SN in the sheet conveyance direction DP increases the temperature of the fixing belt 38 at the downstream portion SNd of the fixing nip SN in the sheet conveyance direction DP effectively compared to the resistive heat generation layer 50*a* disposed opposite the center SNc of the fixing nip SN in the sheet conveyance direction DP.

Figure 7:
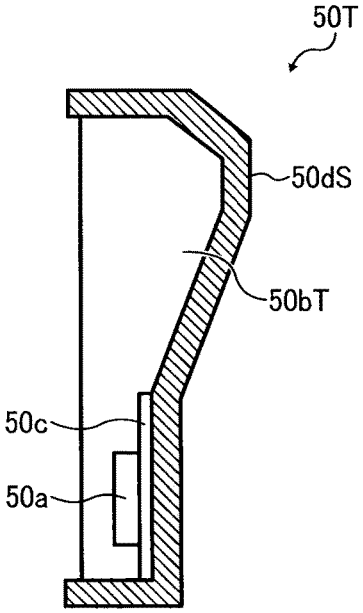
FIG. 7 is a vertical cross-sectional view of a heater as a first variation of a heater incorporated in the fixing device illustrated in FIG. 5.

Referring to FIG. 7, a description is provided of a configuration of a heater 50T as a first variation of the heater 50S depicted in FIG. 5.

FIG. 7 is a vertical cross-sectional view of the heater 50T. As illustrated in FIG. 7, the heater 50T includes a substrate 50*b*T molded or contoured in accordance with the shape of the thermal conductor 50*d*S with substantially no gap between the substrate 50*b*T and the thermal conductor 50*d*S. Accordingly, the thermal conductor 50*d*S attains a sufficient mechanical strength of the fixing belt 38 at the downstream portion SNd of the fixing nip SN in the sheet conveyance direction DP. Heat is not conducted to the substrate 50*b*T having a decreased thermal conductivity readily, enhancing efficiency in conduction of heat to the sheet P.

A description is provided of a configuration of a heater 50U as a second variation of the heater 50S depicted in FIG. 5.

Figure 8:
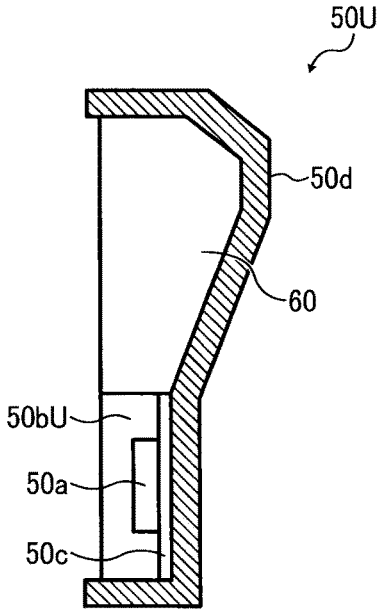
FIG. 8 is a vertical cross-sectional view of a heater as a second variation of the heater incorporated in the fixing device illustrated in FIG. 5.

FIG. 8 is a vertical cross-sectional view of the heater 50U. As illustrated in FIG. 8, the heater 50U includes a substrate 50*b*U shortened in the sheet conveyance direction DP and disposed opposite the upstream portion SNu of the fixing nip SN in the sheet conveyance direction DP to surround the resistive heat generation layer 50*a* and a heat resistant support 60 disposed opposite the downstream portion SNd of the fixing nip SN in the sheet conveyance direction DP. The support 60 is made of a material less expensive than a material of the substrate 50*b*U, reducing manufacturing costs. The support 60 has a thermal conductivity smaller than a thermal conductivity of the substrate 50*b*U, enhancing efficiency in conduction of heat to the sheet P.

A description is provided of a configuration of a heater 50V as a third variation of the heater 50S depicted in FIG. 5.

Figure 9:
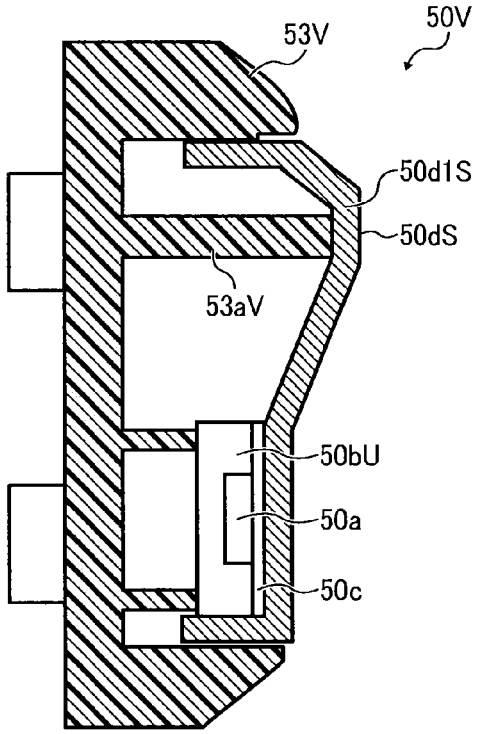
FIG. 9 is a vertical cross-sectional view of a heater as a third variation of the heater incorporated in the fixing device illustrated in FIG. 5.

FIG. 9 is a vertical cross-sectional view of the heater 50V. As illustrated in FIG. 9, the heater 50V includes the substrate 50*b*U shortened in the sheet conveyance direction DP to surround the resistive heat generation layer 50*a* and a heater holder 53V incorporating a projection 53*a*V disposed opposite the downstream portion SNd of the fixing nip SN in the sheet conveyance direction DP to support the thermal conductor 50*d*S. The heater holder 53V may include a plurality of projections 53*a*V that supports the thermal conductor 50*d*S to produce a gap between the heater holder 53V and the thermal conductor 50*d*S. The heater holder 53V attains the mechanical strength of the projection 50*d*1S (e.g., a tilt portion) of the thermal conductor 50*d*S and prevents heat conducted from the resistive heat generation layer 50*a* to the thermal conductor 50*d*S from flowing back to the resistive heat generation layer 50*a*, thus enhancing efficiency in conduction of heat to the sheet P.

The projection 53*a*V of the heater holder 53V that supports the projection 50*d*1S of the thermal conductor 50*d*S may be a thermal conductor having a decreased thermal conductivity.

A description is provided of a configuration of a fixing device 12W according to a third exemplary embodiment.

Figure 10:
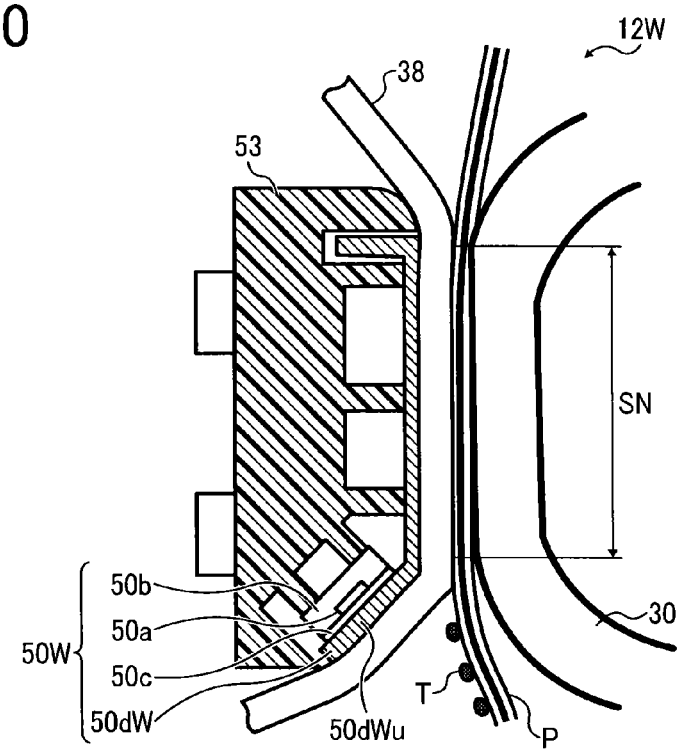
FIG. 10 is an enlarged vertical cross-sectional view of a fixing device according to a third exemplary embodiment of the present disclosure illustrating the fixing nip.

FIG. 10 is an enlarged vertical cross-sectional view of the fixing device 12W illustrating the fixing nip SN. It is to be noted that identical reference numerals are assigned to components illustrated in FIG. 10 that are identical to the components illustrated in FIG. 4 and description of the identical components is omitted.

As illustrated in FIG. 10, the fixing device 12W includes a heater 50W including a thermal conductor 50*d*W having a length greater than the length of the fixing nip SN in the sheet conveyance direction DP. The resistive heat generation layer 50*a* is disposed opposite an upstream portion 50*d*Wu of the thermal conductor 50*d*W that is disposed upstream from the fixing nip SN in the sheet conveyance direction DP. Since the resistive heat generation layer 50*a* heats the fixing belt 38 immediately before the fixing belt 38 enters the fixing nip SN, even if the fixing belt 38 rotates at high speed, the heater 50W conducts a sufficient amount of heat to the fixing belt 38 while the fixing belt 38 moves through the fixing nip SN. Accordingly, as the heater 50W presses the fixing belt 38 against the pressure roller 30 at the fixing nip SN, the heater 50W enhances efficiency in conduction of heat to the sheet P, shortening the warm-up time and reducing power consumption.

Alternatively, the thermal conductor 50*d*W may include the projection 50*d*1S being disposed opposite the downstream portion SNd of the fixing nip SN in the sheet conveyance direction DP and projecting toward the pressure roller 30 as illustrated in FIG. 5. For example, the projection 50*d*1S may be tilted toward the pressure roller 30 in cross-section.

Figure 11:
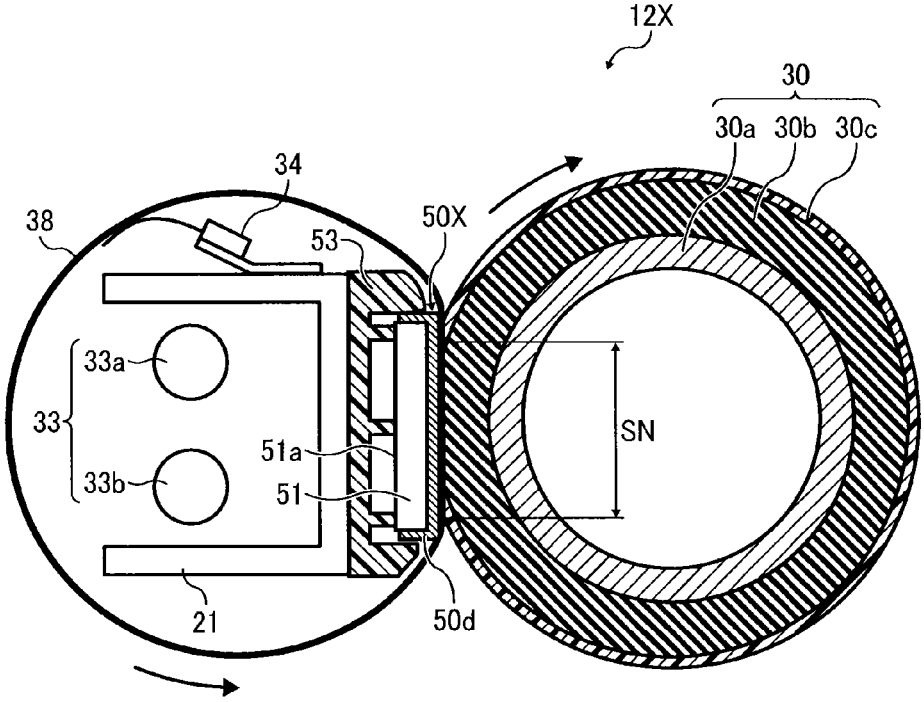
FIG. 11 is a schematic vertical cross-sectional view of a fixing device according to a fourth exemplary embodiment of the present disclosure.

Referring to FIG. 11, a description is provided of a configuration of a fixing device 12X according to a fourth exemplary embodiment.

Sheets P not greater than an A3 size sheet are used frequently. However, a large sheet P of an A3 extension size that is slightly greater than the A3 size sheet may be used. If the fixing device 12 includes an elongated heater configured to have an increased heating span to heat the A3 extension size sheet, the elongated heater is energized unnecessarily while the A3 size sheet is conveyed through the fixing device 12, wasting energy. To address this circumstance, the fixing device 12X heats the large sheet P used infrequently but requested by users without waste of energy as below.

FIG. 11 is a schematic vertical cross-sectional view of the fixing device 12X. It is to be noted that identical reference numerals are assigned to components illustrated in FIG. 11 that are identical to the components illustrated in FIG. 2 and description of the identical components is omitted.

As illustrated in FIG. 11, the fixing device 12X includes the fixing belt 38, the pressure roller 30, a halogen heater pair 33 serving as a heat source, a nip formation pad 51, and a heater 50X mounted on each lateral end of the nip formation pad 51 in a longitudinal direction thereof parallel to the axial direction of the fixing belt 38. The heater 50X includes the thermal conductor 50*d* mounted on the nip formation pad 51.

The halogen heater pair 33 is a heat source disposed opposite an inner circumferential surface of the fixing belt 38 to heat the fixing belt 38. The halogen heater pair 33 includes a first halogen heater 33*a* having a dense light distribution disposed opposite a center span of the fixing belt 38 in the axial direction thereof and a second halogen heater 33*b* having a dense light distribution disposed opposite each lateral end span of the fixing belt 38 in the axial direction thereof.

The nip formation pad 51 may be coupled with the thermal conductor 50*d* at each lateral end of the nip formation pad 51 in the longitudinal direction thereof. Thus, the nip formation pad 51 mounts the heater 50X at each lateral end of the nip formation pad 51 in the longitudinal direction thereof. A back face 51*a* of the nip formation pad 51 is contacted and supported by the heater holder 53 against pressure exerted from the pressure roller 30 through the thermal conductor 50*d*. The heater holder 53 is mounted on and supported by a pressure stay 21. A detailed description of a configuration of the nip formation pad 51 is deferred.

The pressure stay 21 has a mechanical strength great enough to support the nip formation pad 51 against pressure from the pressure roller 30 to prevent bending of the nip formation pad 51. The pressure stay 21 is made of metal such as stainless steel and iron or metallic oxide such as ceramics. Both lateral ends of the pressure stay 21 in the axial direction of the fixing belt 38 are secured to side plates of the fixing device 12X, respectively, thus being positioned inside the fixing device 12X.

An inner circumferential surface of the pressure stay 21 mounts a reflection plate. The reflection plate is produced by polishing a surface of a metal material into a mirror face. The reflection face reflects heat or light radiated from the heat source, that is, the first halogen heater 33*a* and the second halogen heater 33*b*, toward the fixing belt 38 to reduce an amount of heat conducted to the pressure stay 21, thus improving heating efficiency of heating the fixing belt 38. Alternatively, instead of the reflection plate, the inner circumferential surface of the pressure stay 21 may be treated with insulation or mirror finish to reflect heat or light radiated from the first halogen heater 33*a* and the second halogen heater 33*b* toward the fixing belt 38.

Figure 12:
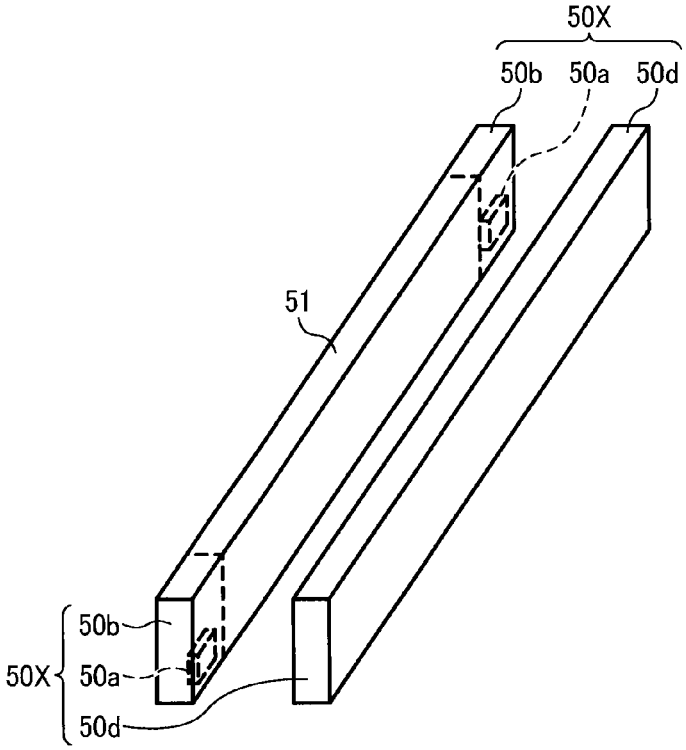
FIG. 12 is a perspective view of a heater and a nip formation pad incorporated in the fixing device illustrated in FIG. 11.

FIG. 12 is a perspective view of the heater 50X and the nip formation pad 51 incorporated in the fixing device 12X. As illustrated in FIG. 12, each lateral end of the nip formation pad 51 in the longitudinal direction thereof mounts the substrate 50*b* and the resistive heat generation layer 50*a*. The substrate 50*b* and the resistive heat generation layer 50*a* define a heat generation span at each lateral end of the fixing nip SN in the longitudinal direction thereof.

The resistive heat generation layer 50*a* has a length in the sheet conveyance direction DP that is smaller than the length of the fixing nip SN in the sheet conveyance direction DP. The resistive heat generation layer 50*a* is disposed upstream from the center SNc of the fixing nip SN in the sheet conveyance direction DP. The thermal conductor 50*d* coupled with the nip formation pad 51 reduces a slight step and a temperature differential produced at a boundary between a center portion of the nip formation pad 51 and the substrate 50*b* disposed at each lateral end of the nip formation pad 51 in the longitudinal direction thereof.

Optionally, the thermal conductor 50*c* serving as a thermal conductor supplement may be sandwiched between the resistive heat generation layer 50*a* and the thermal conductor 50*d* to facilitate conduction of heat from the resistive heat generation layer 50*a* to the thermal conductor 50*d*.

A description is provided of dimensions of the substrate 50*b* and the resistive heat generation layer 50*a* of the heater 50X disposed at each lateral end of the nip formation pad 51 in the longitudinal direction thereof.

A width of the A3 size sheet in portrait orientation and a width of the A4 size sheet in landscape orientation are smaller than a width of the A3 extension size sheet in portrait orientation (e.g., 329 mm) and a width of the 13-inch sheet in portrait orientation (e.g., 330 mm) by a total differential in a range of from 32 mm to 33 mm, respectively. Accordingly, if the substrate 50*b* and the resistive heat generation layer 50*a* of the heater 50X disposed at each lateral end of the nip formation pad 51 in the longitudinal direction thereof heat each lateral end span in a range of from 16.0 mm to 16.5 mm defined by dividing the total differential equally, the fixing device 12X fixes a toner image T on a sheet P varying from the A3 size sheet to the A3 extension size sheet and the 13-inch sheet. Hence, the substrate 50*b* and the resistive heat generation layer 50*a* of the heater 50X span a width of about 20 mm in the axial direction of the fixing belt 38.

Figure 13:
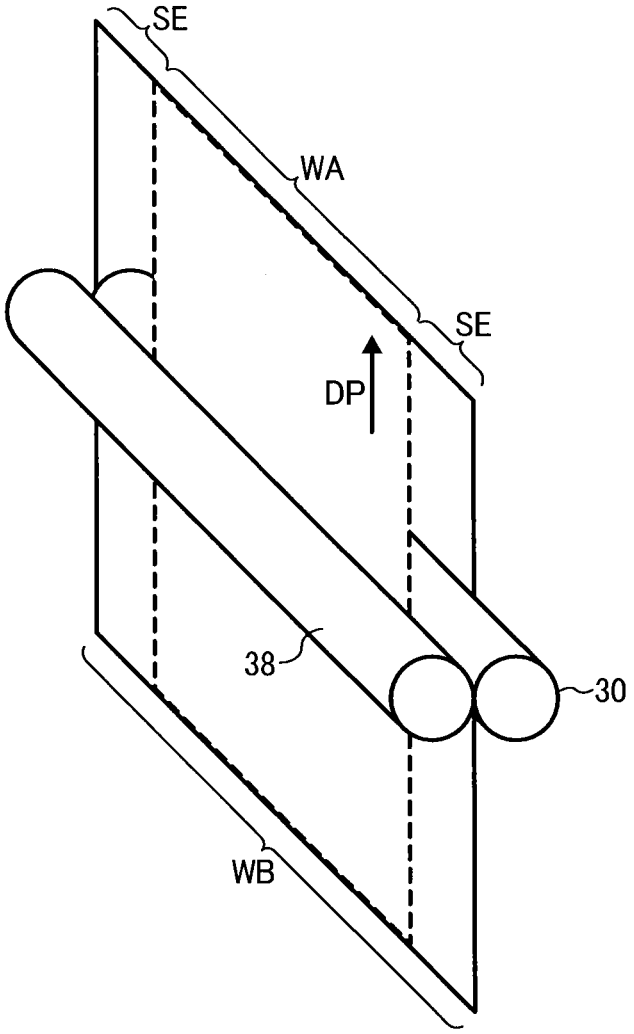
FIG. 13 is a schematic diagram illustrating sizes of sheets conveyed through the fixing nip.

FIG. 13 is a schematic diagram illustrating sizes (e.g., widths) of sheets conveyed through the fixing nip SN. As illustrated in FIG. 13, a width WA in the axial direction of the fixing belt 38 defines a width of sheets not greater than the A3 size sheet. A width WB in the axial direction of the fixing belt 38 defines a width of sheets slightly greater than the A3 size sheet such the A3 extension size sheet.

Referring to FIGS. 11 to 13, a description is provided of a method for heating the sheets performed by the fixing device 12X depicted in FIG. 11.

As the A3 size sheet having the width WA is conveyed through the fixing nip SN, the first halogen heater 33*a* and the second halogen heater 33*b* are energized to heat the fixing belt 38. Conversely, as a sheet having a width smaller than the width WA of the A3 size sheet is conveyed through the fixing nip SN, the first halogen heater 33*a* having the center dense distribution disposed opposite the center span of the fixing belt 38 in the axial direction thereof is energized to heat the fixing belt 38. That is, the first halogen heater 33*a* and the second halogen heater 33*b* heat a substantially center span of the fixing belt 38 that corresponds to the width WA of the A3 size sheet.

As a large sheet (e.g., the A3 extension size sheet and the 13-inch sheet) is conveyed through the fixing nip SN, in addition to the first halogen heater 33*a* and the second halogen heater 33*b*, the resistive heat generation layer 50*a* disposed opposite each lateral end of the fixing nip SN in the longitudinal direction thereof is energized to heat each lateral end span SE of the fixing belt 38 that is outboard from the substantially center span of the fixing belt 38 in the axial direction thereof because the first halogen heater 33*a* and the second halogen heater 33*b* do not heat each lateral end span SE of the fixing belt 38 in the axial direction thereof. That is, the resistive heat generation layer 50*a* disposed opposite each lateral end span SE of the fixing belt 38 in the axial direction thereof heats each lateral end of the large sheet such as the A3 extension size sheet and the 13-inch sheet in the axial direction of the fixing belt 38.

As described above, the fixing device 12X powers on and off the second halogen heater 33*b* and the resistive heat generation layer 50*a* mounted on each lateral end of the nip formation pad 51 in the longitudinal direction thereof according to the size of the sheet. Accordingly, the fixing device 12X heats the large sheet used infrequently without waste of energy used to heat the non-conveyance span of the fixing belt 38 in the axial direction thereof where a sheet smaller than the large sheet is not conveyed over the fixing belt 38.

The present disclosure is not limited to the details of the exemplary embodiments described above and various modifications and improvements, such as combination of two or more of the first exemplary embodiment, the second exemplary embodiment, the third exemplary embodiment, and the fourth exemplary embodiment, are possible. For example, the fixing device 12X according to the fourth exemplary embodiment depicted in FIG. 11 includes the halogen heater pair 33 constructed of the two halogen heaters, that is, the first halogen heater 33*a* and the second halogen heater 33*b*. Alternatively, the fixing device 12X may include one halogen heater or three or more halogen heaters.

A description is provided of advantages of the fixing devices 12, 12S, 12W, and 12X.

As illustrated in FIGS. 2, 5, 7, 8, 9, 10, 11, and 12, the fixing devices 12, 12S, 12W, and 12X include a heater (e.g., the heaters 50, 50S, 50T, 50U, 50V, 50W, and 50X) to generate heat, a fixing rotator (e.g., the fixing belt 38) to rotate while contacting the heater, and a pressure rotator (e.g., the pressure roller 30) to press against the heater via the fixing rotator to form the fixing nip SN between the fixing rotator and the pressure rotator. As a recording medium (e.g., a sheet P) bearing a toner image T is conveyed through the fixing nip SN, the fixing rotator and the pressure rotator fix the toner image T on the recording medium under heat and pressure. The heater includes an insulative substrate (e.g., the substrate 50*b*) and a resistive heat generation layer (e.g., the resistive heat generation layer 50*a*) mounted on the substrate. The resistive heat generation layer is disposed upstream from the center SNc of the fixing nip SN in a recording medium conveyance direction (e.g., the sheet conveyance direction DP).

Accordingly, the resistive heat generation layer disposed upstream from the center SNc of the fixing nip SN in the recording medium conveyance direction heats the fixing rotator, the recording medium, and toner of the toner image T on the recording medium for an extended period of time. Consequently, the resistive heat generation layer increases an amount of heat conducted to the toner of the toner image T on the recording medium, shortens the warm-up time, and reduces power consumption.

As illustrated in FIG. 12, the substrate 50*b* and the resistive heat generation layer 50*a* of the heater 50X are disposed at each lateral end of the nip formation pad 51 in the longitudinal direction thereof because the fixing device 12X employs a center conveyance system in which the sheet P is centered on the fixing belt 38 in the axial direction thereof. Alternatively, the substrate 50*b* and the resistive heat generation layer 50*a* of the heater 50X may be disposed at one lateral end of the nip formation pad 51 in the longitudinal direction thereof if the fixing device 12X employs a lateral end conveyance system in which the sheet P is conveyed in the sheet conveyance direction DP along one lateral end of the fixing belt 38 in the axial direction thereof. In this case, the substrate 50*b* and the resistive heat generation layer 50*a* of the heater 50X are distal from the lateral end of the fixing belt 38 in the axial direction thereof.

According to the exemplary embodiments described above, the fixing belt 38 serves as a fixing rotator. Alternatively, a fixing roller, a fixing film, a fixing sleeve, or the like may be used as a fixing rotator. Further, the pressure roller 30 serves as a pressure rotator. Alternatively, a pressure belt or the like may be used as a pressure rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A fixing device comprising:

a heater to generate heat;

a fixing rotator to rotate while contacting the heater; and a pressure rotator to press against the heater via the fixing rotator to form a fixing nip between the fixing rotator and the pressure rotator, the fixing nip through which a recording medium bearing a toner image is conveyed, the heater including:

an insulative substrate;

a resistive heat generation layer mounted on the substrate, the resistive heat generation layer being disposed upstream from a center of the fixing nip in a recording medium conveyance direction; and a thermal conductor, wherein the resistive heat generation layer is disposed opposite the fixing rotator via the thermal conductor.

2. The fixing device according to claim 1, wherein:

the thermal conductor is separably mounted on the substrate.

3. The fixing device according to claim 2, wherein:

a thermal conductivity of the thermal conductor is greater than a thermal conductivity of the substrate.

4. The fixing device according to claim 2, wherein the thermal conductor includes a metal plate extended and coupled with the fixing rotator throughout an entire width of the fixing nip in an axial direction of the fixing rotator.

5. The fixing device according to claim 2, wherein the thermal conductor includes a projection projecting from a downstream end of the thermal conductor in the recording medium conveyance direction toward the pressure rotator.

6. The fixing device according to claim 2, wherein the thermal conductor includes a projection tilted toward the pressure rotator in cross-section in a span defined from a downstream end of an upstream portion of the fixing nip to a downstream end of a downstream portion of the fixing nip in the recording medium conveyance direction.

7. The fixing device according to claim 2, wherein the thermal conductor has a substantially uniform thickness at the fixing nip.

8. The fixing device according to claim 7, wherein the resistive heat generation layer adheres to the thermal conductor in a longitudinal direction of the thermal conductor.

9. The fixing device according to claim 7, wherein the heater further includes a thermal conductor supplement sandwiched between the resistive heat generation layer and the thermal conductor, and wherein the resistive heat generation layer adheres to the thermal conductor via the thermal conductor supplement.

10. The fixing device according to claim 2, wherein a length of the thermal conductor is greater than a length of the fixing nip in the recording medium conveyance direction.

11. The fixing device according to claim 10, wherein the thermal conductor includes an upstream portion disposed upstream from the fixing nip in the recording medium conveyance direction and disposed opposite the resistive heat generation layer.

12. The fixing device according to claim 2, wherein the substrate is contoured along the thermal conductor with substantially no gap between the substrate and the thermal conductor.

13. The fixing device according to claim 2, wherein the substrate is disposed opposite an upstream portion of the fixing nip in the recording medium conveyance direction.

14. The fixing device according to claim 13, further comprising:

a support disposed opposite a downstream portion of the fixing nip in the recording medium conveyance direction to support the thermal conductor.

15. The fixing device according to claim 14, further comprising:

a heater holder to support the heater, the heater holder including a projection disposed opposite the downstream portion of the fixing nip in the recording medium conveyance direction to support the thermal conductor.

16. The fixing device according to claim 1, further comprising:

a nip formation pad to press against the pressure rotator via the fixing rotator to form the fixing nip, the nip formation pad mounting the heater.

17. The fixing device according to claim 1, further comprising:

a heat source disposed opposite a center span of the fixing rotator in an axial direction of the fixing rotator to heat the fixing rotator, wherein the heater is disposed opposite a lateral end span of the fixing rotator in the axial direction of the fixing rotator.

18. A fixing device, comprising:

a heater to generate heat;

a fixing rotator to rotate while contacting the heater; and a pressure rotator to press against the heater via the fixing rotator to form a fixing nip between the fixing rotator and the pressure rotator, the fixing nip through which a recording medium bearing a toner image is conveyed, the heater including:

an insulative substrate; and a resistive heat generation layer mounted on the substrate, the resistive heat generation layer being disposed upstream from a center of the fixing nip in a recording medium conveyance direction; and a nip formation pad to press against the pressure rotator via the fixing rotator to form the fixing nip, the nip formation pad mounting the heater, wherein the substrate and the resistive heat generation layer are mounted on a lateral end of the nip formation pad in a longitudinal direction of the nip formation pad.

19. An image forming apparatus comprising:

an image bearer to bear a toner image; and a fixing device disposed downstream from the image bearer in a recording medium conveyance direction to fix the toner image on a recording medium, the fixing device including:

a heater to generate heat;

a fixing rotator to rotate while contacting the heater; and a pressure rotator to press against the heater via the fixing rotator to form a fixing nip between the fixing rotator and the pressure rotator, the fixing nip through which the recording medium bearing the toner image is conveyed, the heater including:

an insulative substrate;

a resistive heat generation layer mounted on the substrate, the resistive heat generation layer being disposed upstream from a center of the fixing nip in a recording medium conveyance direction; and a thermal conductor, wherein the resistive heat generation layer is disposed opposite the fixing rotator by the thermal conductor.

* * * * *